US005890351A

United States Patent [19]

Shiotari

[11] Patent Number: 5,890,351

[45] Date of Patent: Apr. 6, 1999

[54] DISPOSABLE BAG MAKER

[75] Inventor: Akira Shiotari, Tokorobawa, Japan

[73] Assignee: Y. S. Kim, Houston, Tex.

[21] Appl. No.: 935,264

[22] Filed: Sep. 22, 1997

[51] Int. Cl.[6] ..... B65B 09/10

[52] U.S. Cl. ..... 53/567; 53/390; 225/32; 225/49

[58] Field of Search ..... 53/390, 567; 206/554; 220/407; 225/32, 48, 49

[56] References Cited

U.S. PATENT DOCUMENTS

| | | |
|---|---|---|
| 3,321,888 | 5/1967 | Kirkhot et al. . |
| 3,392,825 | 7/1968 | Gale et al. . |
| 3,800,503 | 4/1974 | Maki . |
| 4,002,006 | 1/1977 | Bruno . |
| 4,453,649 | 6/1984 | Origuchi . |
| 4,714,191 | 12/1987 | Richardson . |
| 4,863,027 | 9/1989 | Yano . |
| 4,869,049 | 9/1989 | Richards et al. . |
| 4,958,733 | 9/1990 | Masuda . |
| 5,024,349 | 6/1991 | Haenni et al. . |
| 5,118,022 | 6/1992 | Farahnik . |
| 5,183,157 | 2/1993 | Darden . |
| 5,433,363 | 7/1995 | Simhaee . |

*Primary Examiner*—Daniel B. Moon
*Attorney, Agent, or Firm*—Browning Bushman

[57] ABSTRACT

A disposable bag making apparatus that comprises a container for holding an elongate flexible plastic tube. The container includes a first wall and an aperture in the first wall through which a free end of the compacted elongate tube can project. A cutter is formed on the container whereby any desired length of the tube can be pulled through the aperture and brought into contact with the cutter and severed to form various sized disposable bags.

10 Claims, 2 Drawing Sheets

FIG. 5
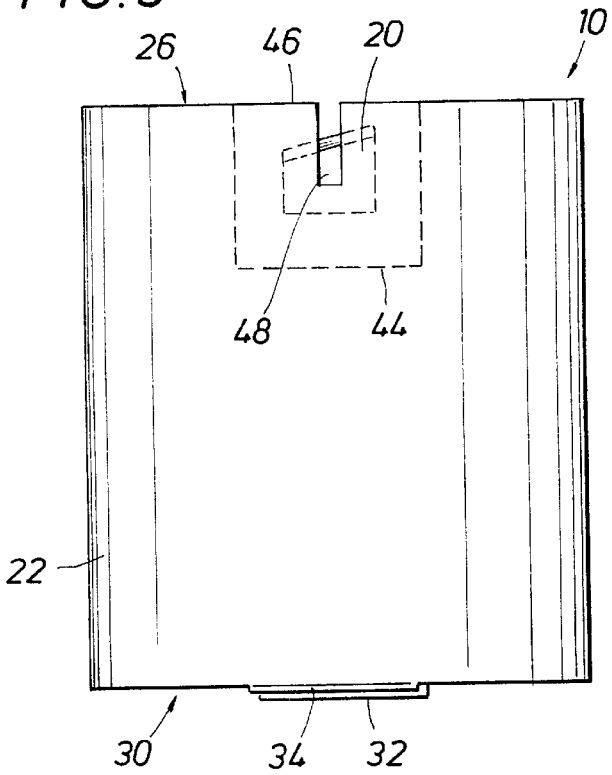
FIG. 8
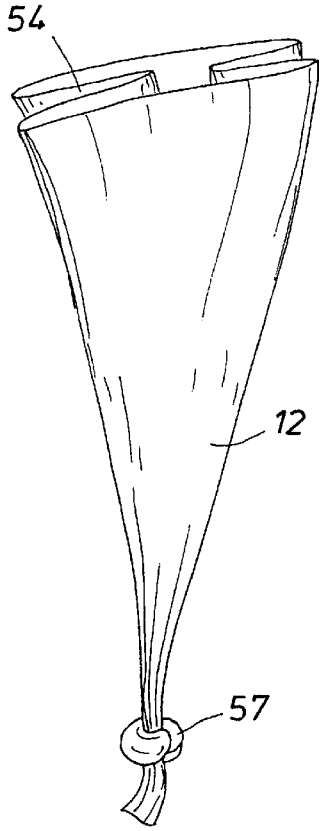
FIG. 6
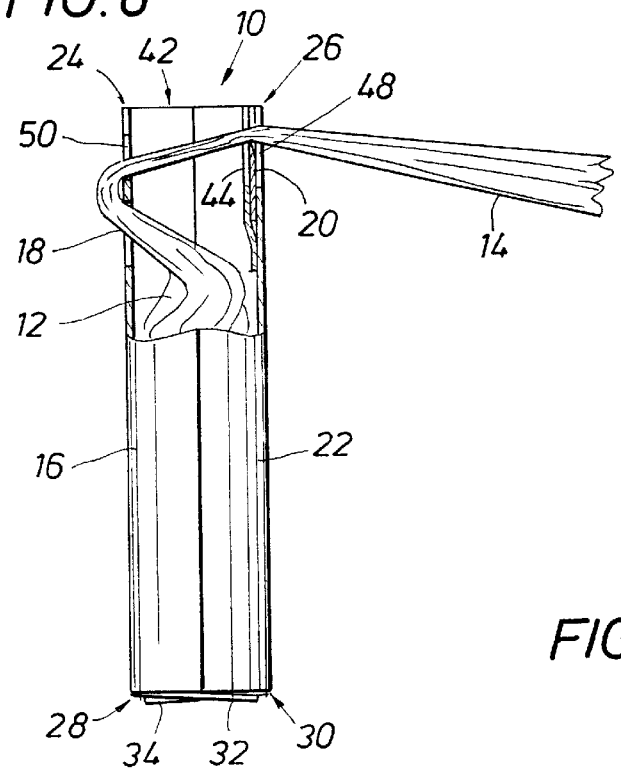
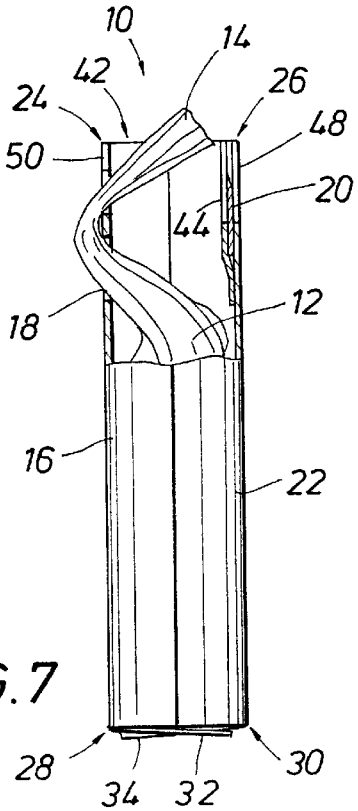
FIG. 7

DISPOSABLE BAG MAKER

FIELD OF THE INVENTION

The present invention relates to a disposable bag making apparatus for dispensing a flexible tubular plastic material that may be tied at one end and formed into a disposable bag once the tubular plastic material is dispensed. In particular, the, present invention relates to a compact disposable bag making apparatus that is capable of dispensing and cutting a flexible tubular plastic material at selected lengths for forming a disposable bag.

BACKGROUND OF THE INVENTION

Various shapes and designs have been utilized to construct a container capable of dispensing disposable refuse or storage bags. Conventional containers of this type may be manufactured from rigid plastic materials that are neither flexible nor compact, and must be large enough to house an established number of plastic bags for dispensing. Such containers are normally too large to carry on one's person and generally are manufactured from expensive plastics involving complex and costly manufacturing techniques. In fact, some containers and bags are environmentally hazardous, requiring special disposal.

Furthermore, conventional containers typically dispense flexible bags of a predetermined size and are incapable of dispensing tubular lengths of flexible polymeric material that may be formed into disposable bags of various selected sizes. For example, although a number of conventional bags used for garbage, groceries and the like may be disposable, all are dispensed in predetermined sizes regardless of the consumer's preference for various or different sized disposable bags. Thus, a consumer is required to purchase more disposable bags than may be necessary for the consumer's particular needs at the time, resulting in unnecessary expense to the consumer. Therefore, the prior art is replete with various containers, dispensers and the like, that are limited to dispensing disposable bags of predetermined sizes from containers that are rigid, bulky, costly and not easily disposed of.

Accordingly, the disadvantages of the prior art are overcome by the present invention which provides a disposable bag making apparatus that is capable of dispensing various select lengths of an elongate flexible plastic tube that may be subsequently formed into disposable bags and is compact, lightweight and environmentally safe for disposal after use.

SUMMARY OF THE INVENTION

It is therefore a general object of the present invention to provide a disposable bag making apparatus capable of dispensing various selected lengths of a tubular flexible polymeric material that may be formed into disposable bags.

It is another object of the present invention to provide a compact and lightweight disposable bag making apparatus capable of dispensing a tubular flexible plastic material that may be severed at various lengths to form different sized disposable bags.

It is a feature of the present invention to provide a compact and lightweight disposable bag making apparatus that dispenses a tubular flexible plastic material of various select lengths, and may be easily disposed of once the container is emptied.

It is another feature of the present invention to provide a disposable bag making apparatus for dispensing various lengths of tubular flexible plastic material that is compact and lightweight enough to fit into a consumer's pocket or purse.

It is yet another feature of the present invention to provide a compact and light weight disposable bag making apparatus manufactured from disposable and inexpensive materials that are environmentally safe for disposal.

The present invention is therefore, directed to a disposable bag making apparatus that comprises a container for holding an elongate flexible plastic tube in compacted form. The container includes a first wall and an aperture in the first wall through which a free end of the compacted elongate tube can project. A cutter is formed on the container whereby any desired length of the tube can be pulled through the aperture and brought into contact with the cutter and severed to form various sized disposable bags.

In one embodiment of the present invention, the first wall includes a top end and a bottom end, and a second wall includes a top end and a bottom end. A first tab extends from the bottom end of the first wall and a second tab extends from the bottom end of the second wall for interlocking and providing a surface on which the elongate tube may rest within the container. Alternatively, a bottom surface may be included to connect the bottom end of the first wall and the bottom end of the second wall for supporting the elongate tube. The first wall also includes a first end connected to a first end of the second wall. Thus, the first and second walls of the container are integral at one end and at another end are connected between the first end of the first wall and the first end of the second wall. Preferably, the top end of the first wall and the top end of the second wall form an opening there between for introduction of the elongate tube into the container. Alternatively, the first and second walls may form a point of connection instead of being integral to one another. The second wall includes a pocket formed on the top end of a radially inward portion of the second wall for receipt of a cutter. The top of end of the second wall also includes a peripheral edge and a first slot formed in the peripheral edge in register with the cutter for guiding and securing the elongate tube through the second wall for cutting the elongate tube to a desired length.

In another embodiment, the cutter may be received in a pocket positioned on a radially outward portion of the second wall in register with the first slot, or on a radially inward or outward portion of the first wall in register with the aperture. The first wall also includes a second slot in register with the first slot. The alignment of the first slot and second slot further guide and secure the elongate tube as it passes through the first and second wall and is severed using the cutter. Alternatively, the cutter may be received in a pocket positioned on a radially inward or outward portion of the first wall and in register with the second slot.

The elongate tube is preferably compacted along its length by accordion folds and is likewise compacted along its width by accordion folds to maximize the length of tube that can be stored in the container and allow the elongate tube to unfold and form a disposable bag. The second slot includes a lower generally circular aperture for retaining the elongate tube within the first wall once the elongate tube has been severed. Thus, retention of the elongate tube within the second slot after being severed allows the free end to be easily grasped and guided through the first slot to cut another length of elongate tube.

The container is preferably manufactured form environmentally safe and disposable paper products such as cardboard, and is also lightweight and compact enough to carry on a consumer's person, e.g., in a purse. Thus, the container is easily manufactured from inexpensive materials, resulting in an affordable disposable bag making apparatus that is capable of dispensing different sizes of disposable bags depending on the consumers preference.

These and further objects, features and advantages of the present invention become apparent from the following detailed description, wherein reference is made to the figures in the accompanying drawings.

BRIEF DESCRIPTION OF THE DRAWINGS

FIG. 5 is a side view of the present invention demonstrating the cutter used to sever desired lengths of the tubular plastic material.

FIG. 6 is a partial cross-sectional side view demonstrating the path that the tubular plastic material is guided through within the container.

FIG. 7 is a partial cross-sectional side view of the present invention demonstrating the position of the tubular plastic material after it has been cut.

FIG. 8 is a prospective view of the tubular plastic material once it has been cut and formed into a disposable bag.

DETAILED DESCRIPTION OF PREFERRED EMBODIMENTS

Figure 2:
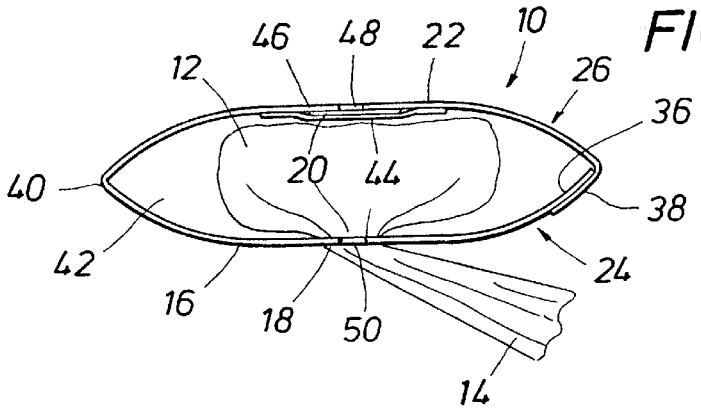
FIG. 2 is a top view of the present invention shown in FIG. 1.
Figure 1:
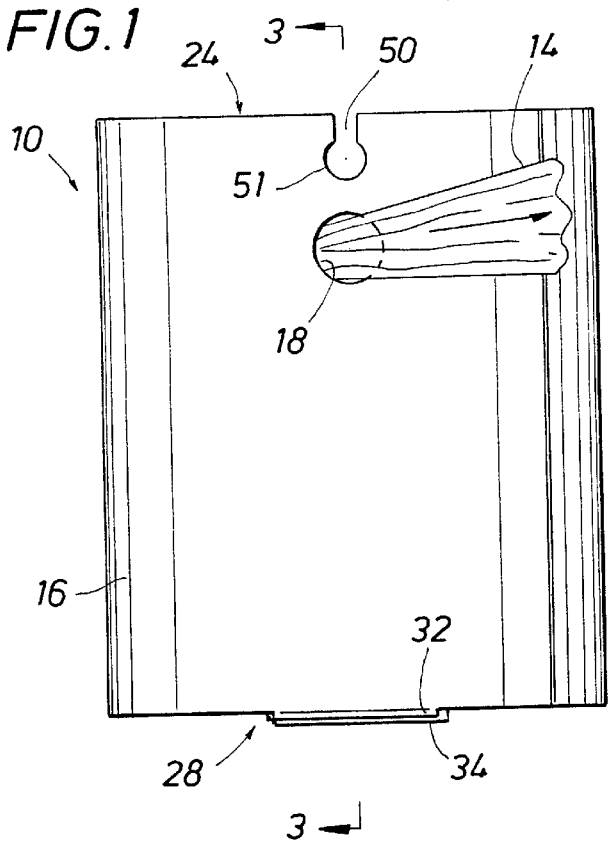
FIG. 1 is a side view of the present invention demonstrating how the tubular plastic material may be dispensed through an aperture in the container's side wall.

Referring now to FIG. 1, a disposable bag making apparatus including a container 10 is shown for holding an elongate flexible plastic tube 12 (FIG. 2). The container 10 includes a first wall 16 and an aperture 18 in the first wall 16 through which a free end 14 of the compacted, layered elongate tube 12 can project there through.

In FIGS. 1 and 5, the container further comprises a second, opposed wall 22. The first wall 16 includes a top end 24 and a bottom end 28. Similarly, the second wall 22 includes a top end 26 and a bottom end 30. A first tab 32 extends from the bottom end 28 of the first wall 16 and a second tab 34 extends from the bottom end 30 of the second wall 22. The first 32 and second 34 tabs include interconnecting formations for interlocking the first 32 and second 34 tabs and providing a surface on which the elongate tube 12 may rest within the container 10. Alternatively, a bottom surface (not shown) may be included to connect the bottom end 28 of the first wall 16 and the bottom end 30 of the second wall 22 for supporting the elongate tube 12. The use of the first 32 and second 34 tabs enables the container 10 to maintain low manufacturing costs while providing a support surface for the elongate tube 12.

Figure 4:
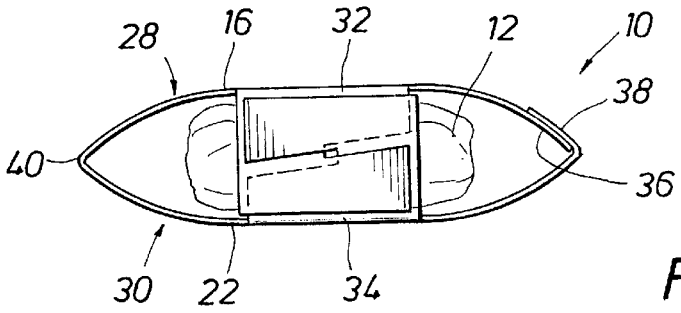
FIG. 4 is a bottom view of the present invention shown in FIG. 1 demonstrating an interlocking pair of tabs to retain the tubular plastic material within the container.

Referring now to FIGS. 2 and 4, the first wall 16 includes a first end 36 connected to a first end 38 of the second wall 22. Thus, the first 16 and second 22 walls of the container 10 are integral at one end 40 and at another end connected between the first end 36 of the first wall 16 and the first end 38 of the second wall 22. Consequently, the container 10 is preferably made from a flexible and disposable material such as cardboard. In a preferred embodiment, the top end 24 of the first wall 16 and the top end 26 of the second wall 22 forms an opening 42 there between for introducing the elongate tube 12 into the container 10. Alternatively, the first 16 and second 22 walls may form a point of connection (not shown) instead of being integral to one another at 40.

Referring generally to FIGS. 5, 6 and 7, the second wall 22 includes a pocket 44 formed on the top end 26 of a radially inward portion of the second wall 22 for receipt of a cutter 20. The top end 26 of the second wall 22 also includes a peripheral edge 46 and a first slot 48 formed in the peripheral edge 46 in register with the cutter 20 for guiding and securing the elongate tube 12 through the second wall 22 for cutting the elongate tube 12 to a desired length. In another embodiment, the cutter 20 may be received in a pocket 44 positioned on a radially outward portion (not shown) of the second wall 22 in register with the first slot 48, or on a radially inward or outward portion (not shown) of the first wall 16 in register with the aperture 18.

The first wall 16 also includes a second slot 50 in register with the first slot 48 as also shown in FIG. 1. The alignment of the first slot 48 and second slot 50 further guide and secure the elongate tube 12 as it passes through the first wall 16 and second wall 22 and is cut severed using the cutter 20 as shown in FIG. 6. In another embodiment, the cutter 20 may be received in a pocket 44 positioned on a radially inward or outward portion of the first wall 16 and in register with the second slot 50.

Figure 3:
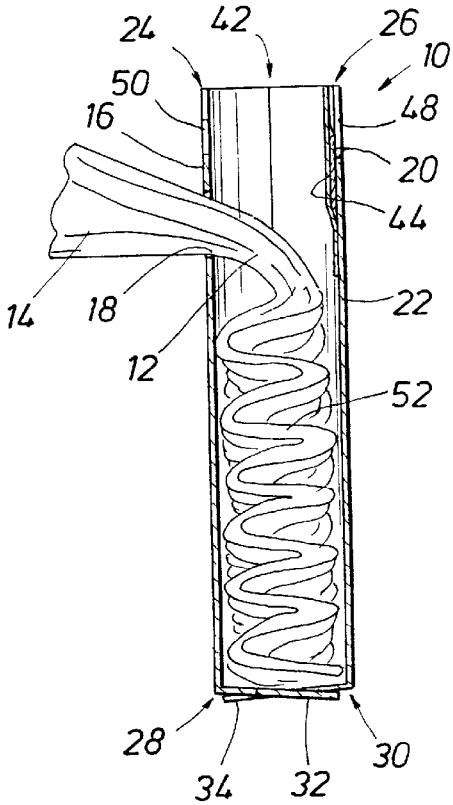
FIG. 3 is a cross-sectional side view of the present invention taken along 3—3 from FIG. 1 and demonstrating how the tubular plastic material is stored within the container.

Referring now to FIGS. 3 and 8, the elongate tube 12 is compacted along its length by accordion folds 52 and is compacted along its width 54 by accordion folds to maximize the amount of tube that can be stored in the container 10 and allow the elongate tube 12 to unfold. Once the desired length of elongate tube 12 has been dispensed, a disposable bag may be formed therefrom by tying a knot 57 at either end as generally shown in FIG. 8. Alternatively, the elongate tube 12 may be compacted into a roll, or any other form suitable for maximum volumetric storage in the container 10, provided the elongate tube 12 is not restricted from performing the desired ends described hereinabove.

In a preferred embodiment, the second slot 50 includes a lower generally circular aperture 51 for retaining the elongate tube 12 within the first wall 16 once the elongate tube 12 has been severed as more particularly shown in FIGS. 1 and 7. Thus, retention of the elongate tube 12 within the second slot 50 after being severed allows the free end 14 to be easily grasped and guided through the first slot 48 to cut another length of elongate tube 12.

The container 10 is preferably manufactured from environmentally safe disposable paper products such as cardboard, and is lightweight and compact enough to carry on the consumer's person. Thus, the container 10 is easily manufactured from inexpensive materials, resulting in an affordable disposable bag making apparatus that is capable of dispersing different sizes of disposable bags according to the consumer's preference.

Although the invention has thus been described in detail for these embodiments, it should be understood that this explanation is for illustration, and that the invention is not limited to these embodiments. Alternate components and installation techniques will be apparent to those skilled in the art in view of this disclosure. Additional modifications are thus contemplated and may be made without departing from the spirit of the invention, which is defined by the claims.

What is claimed is:

1. A disposable bag making apparatus comprising:

an elongate, flexible, plastic tube having a predetermined length and diameter;

a container for holding said elongate tube, said elongate tube being compacted in a layer form and having a free end, said container having a first side wall and a second side wall, each of said first and second side walls having a top end and a bottom end;

a first slot formed in a peripheral edge of said top end of said second side wall and a second slot formed in said first side wall wherein said second slot is in register with said first slot;

an aperture formed in said first side wall through which said free end may be pulled out of said container and positioned in said first and second slots; and a cutter disposed on said second side wall and having a cutting edge extending transverse to and across said first slot inwardly of said top end for severing said elongate tube at a desired length.

2. The apparatus as defined in claim 1, wherein said container further comprises:

a first tab extending inward from said bottom end of said first side wall; and a second tab extending inward from said bottom end of said second side wall, said first and second tabs having interconnecting formations.

3. The apparatus as defined in claim 2, wherein said first wall is integral with said second wall, said first wall having a first side edge connected to a first side edge of said second wall.

4. The apparatus as defined in claim 2, wherein said top end of said first wall and said top end of said second wall form an opening there between for introducing said flexible plastic tube into said container.

5. The apparatus as defined in claim 1, wherein said second side wall creates a pocket formed on said top end, said cutter being received in said pocket.

6. The apparatus as defined in claim 5, wherein said cutter is positioned in said pocket on a radially inward side of said second side wall.

7. The apparatus as defined in claim 1, wherein said second slot extends longitudinally downward from a peripheral edge of said top end of said first side wall and terminates at a generally circular opening for securing said free end of said elongate flexible tube in said first side wall after said flexible tube has been severed.

8. The apparatus as defined in claim 7, wherein said aperture is disposed generally intermediate said second slot and said bottom end of said first wall.

9. The apparatus as defined in claim 1, wherein said compacted tube is layered along said predetermined length by accordion folds.

10. The apparatus as defined in claim 9, wherein said compacted tube is layered along a width defined by said predetermined diameter by accordion folds.

* * * * *